US005423464A

United States Patent [19]

Yuki et al.

[11] Patent Number: 5,423,464

[45] Date of Patent: Jun. 13, 1995

[54] WRAP FILM CONTAINING BOX AND MANUFACTURING METHOD THEREFOR

[75] Inventors: Tadayuki Yuki; Iku Kato, both of Mie, Japan

[73] Assignee: Asahi Kasei Kogyo Kabushiki Kaisha, Osaka, Japan

[21] Appl. No.: 183,399

[22] Filed: Jan. 19, 1994

[30] Foreign Application Priority Data

Jul. 31, 1992 [JP] Japan ..... 4-204710

[51] Int. Cl.[6] ..... B26F 3/02

[52] U.S. Cl. ..... 225/43; 225/48

[58] Field of Search ..... 225/43, 39, 48, 56, 225/77, 91

[56] References Cited

U.S. PATENT DOCUMENTS

| | | | |
|---|---|---|---|
| 1,991,812 | 2/1935 | Marcalus | 225/43 |
| 2,303,253 | 11/1942 | Broeren | 225/43 |
| 2,405,459 | 8/1946 | Smith | 225/43 |
| 4,648,536 | 3/1987 | VanderLugt | 225/43 |
| 4,651,911 | 3/1987 | Kirkup et al. | 225/48 |
| 4,972,984 | 11/1990 | Frank et al. | 225/48 |

FOREIGN PATENT DOCUMENTS

| | | |
|---|---|---|
| 59-28022 | 2/1984 | Japan . |
| 60-195735 | 12/1985 | Japan . |
| 2-37707 | 10/1990 | Japan . |
| 4-32923 | 3/1992 | Japan . |
| 4-48120 | 4/1992 | Japan . |
| 4-62619 | 5/1992 | Japan . |

*Primary Examiner*—Kenneth E. Peterson
*Attorney, Agent, or Firm*—Armstrong, Westerman, Hattori, McLeland, Naughton

[57] ABSTRACT

A wrap film containing box in which a projected portion of a thin sheet out of a serrated member serves as a tab and in which a thin sheet body on the back of the serrated member plays the role of reducing the fastening strength. Therefore, the serrated member can be removed easily and safely without reducing the rigidity of a cardboard portion of the box body where the serrated member is mounted (i.e., without impairing the cutting performance of the serrated member).

5 Claims, 4 Drawing Sheets

WRAP FILM CONTAINING BOX AND MANUFACTURING METHOD THEREFOR

BACKGROUND OF THE INVENTION

1. Field of the Invention

The invention relates to an improvement of a wrap film containing box widely used in ordinary homes, or the like. More particularly, the invention is directed to a wrap film containing box that allows a serrated member to be removed safely and easily at the time of scrapping the box without impairing the cutting function during use, as well as a method of manufacturing such wrap film containing box.

2. Description of the Related Art

A conventional rectangular wrap film containing box is essentially made up of such components as a front plate 1, a bottom plate 2, a rear plate 3, a top plate 4, lateral plates 8, a cover strip 5, extending in such a direction as to cover the front plate 1 from the top plate 4, and lateral cover strips 11 extending in such a direction as to cover the lateral plates 8 as shown in FIG. 2(A) and FIG. 2(B) (e.g., Unexamined Japanese Utility Model Publication No. Sho. 59-28022). Most boxes of this type are made of a cardboard, and are assembled, as shown in FIG. 2(A) by folding a specially prepared unassembled cardboard such as shown in FIGS. 3(A) and 3(B) substantially at right angles to one another along dotted lines to form the surfaces of the above-mentioned component plates and by accommodating therein a wrap film R prepared by rolling a film. At the time of using the wrap film, an opening strip 6 fixed at locally bonded portions 9 is torn off along a cutting line 10 to open the box as shown in FIG. 2(A); a desired wrap film portion F is paid off from the rolled wrap film R; and such paid-off film portion F is cut away by a serrated member K made of a metal and fixed onto the box body.

In the containing box of this type, the metal serrated member is located at various positions. Generally, the serrated member is arranged either in the vicinity of the ridgeline between the bottom plate 2 and the front plate 1, at the upper edge portion of the front plate 1, or at the lower edge portion of the cover strip 5 so that the teeth of the serrated member are projected from the edge portion. Each tooth, used as the cutting tool, takes various forms. In terms of the general shape depicted by a phantom line connecting respective cutting points, the serrated members are linear, concavely arcuate, convexly arcuate, V-projected, trapezoidal, and the like. FIGS. 2(A) and 2(B) show an example in which a metal serrated member K that is linear in terms of connecting the respective cutting points with a phantom line is arranged on a lower end of the cover strip 5 (as viewed from FIGS. 2(A) and 2(B)), the lower end being of a linear shape, and in which the lateral cover strips 11 extending in such a direction as to cover the lateral plates 8 from the top plate 4 are provided to reinforce the cover strip 5.

The metal serrated member K is generally mounted on a predetermined surface of the unassembled cardboard as shown in FIG. 3(A) and FIG. 3(B). In the case of, e.g., FIG. 3(A), a long metal thin plate of uniform width, which is rolled, is paid off from the head end thereof by a predetermined small distance to be sequentially cut and serrated the paid-off metal thin plate portions using a mold, and simultaneously therewith, each cut metal thin plate portion is slit in the longitudinal direction thereof. The slits are raised to form fastening claws 12. As a result, the metal serrated members having the fastening claws are prepared. Flat cardboards, each of which is to be formed into a wrap film containing box and is prepared in advance, are supplied face-down; the fastening claws 12 are inserted into the cardboard, at which a part of the teeth of the serrated member K are projected to the opening strip 6 side from the lower end of the cover strip 5, by biasing the metal serrated member K with the fastening claws 12; and the inserted fastening claws 12 are then fastened while bent flat. As a result, the preparation of an unassembled cardboard with the metal serrated member has been completed.

One of market needs for boxes of this type is that the metal serrated member can be removed safely and easily when the box is disposed of as a waste box. For example, (1) Unexamined Japanese Utility Model Publication No. Sho. 60-195735 proposes a containing box in which a small strip serving as a tab is interposed between a lateral end of the serrated member and a predetermined cardboard portion of the box body, so that the serrated member can be stripped off easily by tearing up the end of the serrated member with this small strip; (2) Unexamined Japanese Utility Model Publication No. Hei. 4-32923 proposes a containing box in which a lateral end of the serrated member is extended and bent on the lateral plate of the box body, so that the serrated member can be torn off easily with the bent, extended lateral end as a tab; (3) Unexamined Japanese Utility Model Publications Nos. Hei. 4-62619 and Hei. 4-48120 propose a containing box in which perforations are bored in a predetermined cardboard portion having the serrated member in such a manner as to enclose the serrated member, so that the serrated member can be removed together with the predetermined cardboard portion while torn off along the perforations at the time the containing box is destroyed; and (4) Examined Japanese Utility Model Publication No. Hei. 2-37707 discloses a structural body in which a plastic film sheet that is as long as the serrated member is interposed between the serrated member and a predetermined cardboard portion of the box body and fastened.

Because of no relation with the invention, the disclosure (4) will be herein described. Such disclosure (4) is closest to the invention in terms of structural body. The plastic film sheet used in disclosure (4) is a "support" for covering the pointed teeth, and is wider than the serrated member while "projected from the teeth of the serrated member in the form of a band." Since the plastic film sheet does not have the role of tearing off the serrated member, there is no "portion projected" from the lateral ends of the serrated member in disclosure (4). Further, in disclosure (4), there is no idea teaching the tearing off of the serrated member, nor is a recitation suggesting the manufacturing method of such invention. No one can manufacture the containing box of the disclosure (4) by using the manufacture method of the present invention.

However, even though the containing boxes according to proposals (1) and (2) are easy to tear off the serrated member up to the fastened portion close to where the small strip is interposed, or up to the fastened portion close to where the tab is arranged, once the distance between the tab and the fastened portion a user wishes to tear off becomes long, the serrated member, itself is forced to be bent at the base of the fastening claw, making the tearing operation thereafter hard. If the serrated member under such condition is torn off at a stroke by force, the serrated member portion torn off in bent form springs back to the hand of the user, placing the users' hand in danger of injury. That is, it is assumed that proposals (1) and (2) consist with require the user to hold the serrated member, itself, by hand and that to tear the serrated member off piecemeal by making the tearing distance to the fastened portion short; i.e., he repeats the tearing operation by repeating his holding of the serrated member many times. Whether directly or indirectly, the condition that the user holds the serrated member, itself, by hand and repeat the holding of the serrated member, many times, may cause injury to his hand by the pointed teeth of the serrated member or the fastening claws being torn off.

On the other hand, proposal (3) addresses the problem but is not practical because the design of proposal (3) impairs the cutting performance because the perforations enclosing the serrated member reduce the rigidity and strength of the cardboard portion on which the serrated member is mounted. Such a problem will be explain with reference to the case of cutting a film in a containing box shown in FIG. 2(B) as follows. The portion of the film about to be paid-off is held while interposed between the front plate 1 and the cover strip 5, whereas the paid-off film end is pulled-out while held by hand, in such a direction as to be bent at an acute angle and abutted against the pointed teeth arranged on the lower end of the cover strip 5. With tension applied to the film under this condition, both the film and the box body are rotated in vertically opposite directions. As a result, the film is abutted against the pointed teethans is cut, by force, in such a manner as to sequentially bite into the sharp teeth of the serrated member from one lateral end to the other. While the cover strip 5, in this case, receives not only a biasing force in the vertical direction from the pointed teeth, but also, a stress in such a direction as to pull the cover strip 5 outward by pulling the pointed teeth at the same time, the cover strip is subjected to a deformation frontwardly. However, as the cardboard portion is weakened by perforations, particularly, by forming a long line of perforations along the serrated member on the cover strip, such deformation frontwardly is added to the above-mentioned deformation of the cover strip caused during the film cutting operation. Because such bending deformation reduces chances of the cutting edges abutting against the film surface at right angles to one another, the cutting performance of the serrated member is reduced. The chance of the cardboard portion being bent, in this way, increases with increasing number of film cutting operations, resulting in the user being unable to cut the film with the largely bent serrated member. On the other hand, modifying the perforations so not to cause the above-mentioned bending deformation, makes the removal of the serrated member, by cutting out the cardboard portion, difficult.

Moreover, the containing boxes of this type have, generally, been developed as mass consumption products to be supplied at low price. Thus, all the box manufacturing processes, including the printing and punching of unassembled cardboards, the forming and mounting of serrated members, as well as the assembling of containing boxes, have been designed to be very quick and automatically continuous. Consequently, any proposals must be technically practicable in terms of their being incorporated into the above-mentioned high-speed, automatically continuous manufacturing containing box line, as well as applicable with only minor modifications of the existing equipment.

SUMMARY OF THE INVENTION

Therefore, the object of the invention is to provide a wrap film containing box with a serrated member and a method of manufacturing such containing box, which can satisfy the following conditions: the cutting performance of the serrated member is not reduced; the serrated member does not come off or is not dropped during transportation or use; the serrated member can be removed safely and easily; the containing box can be manufactured easily using the existing high-speed, automatically continuous equipment, as unmodified, or with only minor modifications; and therefore, the containing box can be supplied inexpensively.

To achieve the above object, the invention is applied to a rectangular wrap film containing box made of a cardboard, which includes as shown in FIGS. 3(A) and 3 (B): a front plate 1; a bottom plate 2; a rear plate 3; a top plate 4; lateral plates 8; and a cover strip 5 extending in such a direction as to cover the front plate 1 from the top plate 4. The wrap film containing box accommodates a rolled wrap film therein and is used by paying off a desired portion of the wrap film and cutting the paid-off portion with a serrated member K made of a metal. In such wrap film containing box, the serrated member K, FIG. 1 is fastened onto a predetermined cardboard surface of the box body through a thin sheet body P, arranged on the back of the serrated member K; and the thin sheet body P has substantially the same width as the serrated member ,and is projected from at least one lateral end of the serrated member K.

A method of manufacturing such wrap film containing box comprises the steps of: overlapping a long metal thin plate and a thin sheet body P in such a manner that a lateral edge of the thin sheet body P is projected from at least one lateral end portion of the long metal thin plate; inserting fastening claws into a predetermined cardboard surface of the box body by biasing a serrated member made of a metal onto the predetermined cardboard surface, the serrated member being serrated and having the fastening claws obtained by raising slits formed locally on the metal thin plate; fastening the serrated member by causing the inserted fastening claws to be bent flat to prepare an unassembled cardboard with the metal serrated member; and bending the unassembled cardboard along dotted lines to assemble the containing box, the dotted lines being prepared in advance on the unassembled cardboard.

DETAILED DESCRIPTION OF THE INVENTION

Figure 1:
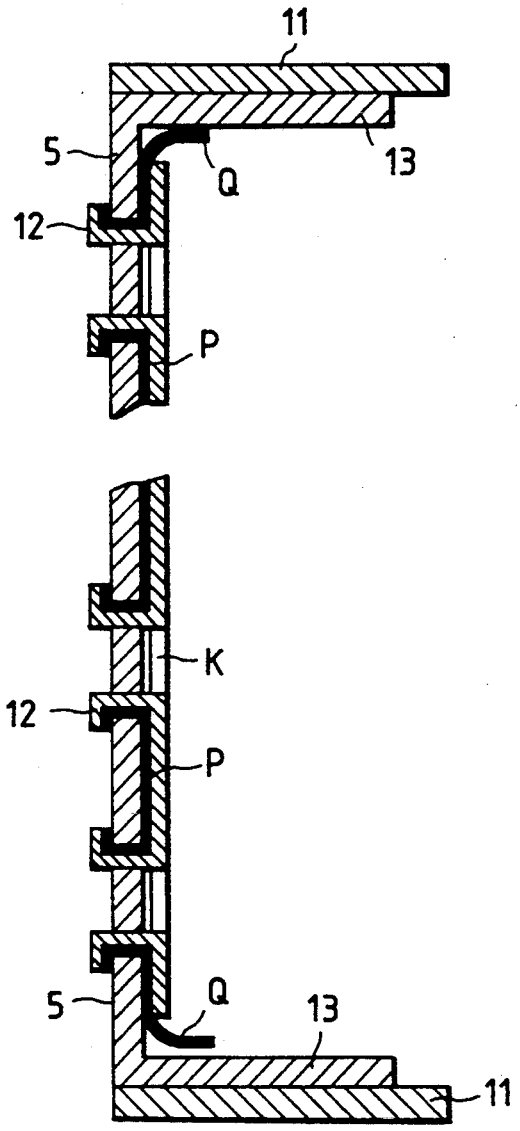
FIG. 1 is a schematic sectional view of a containing box of the present invention taken along a line X—X shown in FIG. 2(B)

The detailed description of the present invention will be described as follows.

The containing box of the invention can be manufactured by the conventional manufacturing methods and equipment except for the following. What distinguishes the invention from the conventional methods is that the long metal thin plate that is to be formed into serrated members has the thin sheet body P overlapped on the back surface thereof with the lateral end of the thin sheet body P projected from at least one of the lateral ends thereof since when the metal thin plate is in long plate form. Therefore, the thin sheet body P is always present on the back of the serrated member, not only when the metal thin plate has been formed into the serrated members but also even after the containing box has been assembled with the serrated member fixed on the predetermined surface of the unassembled cardboard.

Hence, the metal serrated member K is fastened onto a predetermined cardboard portion of the containing box by the fastening claw 12 through the thin sheet body P. Although the serrated member K may be bonded to the thin sheet body P, in advance, with an adhesive, or the like, it is more desirable to simply lay the thin sheet body on the back of the metal thin plate because the incidence of misalignment is unexpectedly low with such a simple overlap. Cut and serrated while overlapped on the back of the metal thin plate, the thin sheet body P has the same serrate shape as the serrated member with the tips of the pointed teeth coincident with one another. Therefore, the thin sheet body P in no way impairs the cutting function of the serrated member, nor does it become hindrance at the time of cutting the film.

The roles to be played by the thin sheet body P in the invention are: to relatively shorten the bending length of the fastening claws 12 and to thereby appropriately reduce the fastening strength; to serve as a lever at the time of tearing the serrated member off, i.e., to concentrate the tearing force on the fastened portions; and to indicate the position at which to start tearing to the user. These roles can be effectively played only when the thin sheet body P has a certain thickness.

Therefore, as long as the thin sheet body P can be serrated easily together with the metal thin plate by a mold with the serration of the thin sheet body being so neat and uniform as to allow the film to be cut as well as is so stiff as to bear the tearing force, no restriction is imposed on the material of which the thin sheet body P is made. Specifically, the materials include ordinary reinforced paper, vulcanized hard-grade fiber, plastic film sheet, woven fabric, nonwoven fabric, or the like. The thickness of the thin sheet body P is selected in accordance with the property of the material thereof and the length of the fastening claw of the serrated member to which the thin sheet body is applied. Generally, a thickness range of from about 0.05 to 1.5 mm, or more preferably, from about 0.1 to 0.8 mm is selected. Among others, a plastic film sheet which has no vertical and horizontal orientation and whose thermal contraction coefficient is small is desirable, because the plastic film sheet is not only strong and is not torn horizontally, but also is flexible and easy to handle during forming. It is important that the thin sheet body P be overlapped so as to be projected from at least one lateral end of the thin metal plate. The projected portion Q serves as a tab for tearing. Therefore, the length of the projected portion is usually set to 5 to 20 mm. The projected portion can be cut out together with the main body at the time of serrating the metal thin plate using the lateral margins of the same mold. The projected portion Q serving as a tab is preferably provided on both lateral ends of the metal serrated member, so that the tearing operation can be performed from either direction. On the other hand, the thin sheet body may be overlapped desirably substantially over the entire back surface of the metal thin plate, because such an overlap can ensure flat rolled condition and stable paying-off of the metal thin plate used in the form of a long, rolled plate. In the case of tearing off the serrated member, itself, directly by hand, the serrated member is greatly bent at the base of the fastening claws in the thickness direction, whereas in the case of tearing off the serrated member having the thin sheet body overlapped on the back thereof, only reasonable small force is required for tearing because the serrated member can be torn while less bent at the base of the fastening claws.

As is apparent from the above description, the advantage provided by the manufacturing method of the invention is to allow the thin sheet body to be formed and mounted economically by utilizing the conventional manufacturing equipment without losing the serrated member forming and mounting efficiency, the thin sheet body being designed to adjust the serrated member fastening strength so that such strength can be appropriately reduced; and serve as a tearing tab and means for concentrating the tearing force on the fastened portions. As a result, a containing box, whose serrated member can be removed safely and easily, can be obtained without impairing the cutting performance.

Figure 4:
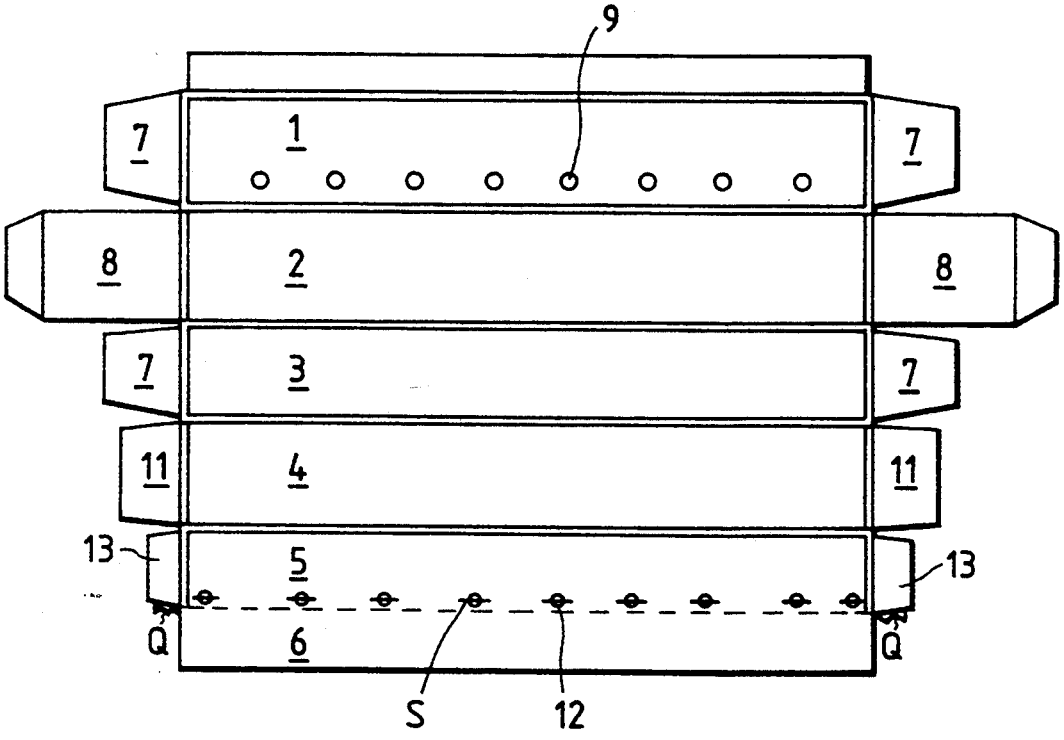
FIG. 4 is a schematic diagram showing another shape of an unassembled cardboard to be formed into the containing box of the invention.

As described above, the basic technical idea of the invention is to allow the metal serrated member to be removed without providing on a predetermined cardboard portion of the box body large perforations that have been the cause of reducing the cutting performance. However, the invention does not exclude possible use of such perforations as not to reduce the strength of the cardboard, i.e., the cutting performance, because the same perforations may have different effects on the cardboard depending on their depth, size, position, or the like. For example, in the case where the serrated member is mounted close to the ridgeline between the bottom plate 2 and the front plate 1, the effect of perforations on reducing the cutting performance is relatively small. Therefore, small perforations may provide the advantage of the invention. On the other hand, some containing boxes have such small slits (e.g., in the order of 2 to 10 mm) as to merely help remove the fastening claws for fastening the serrated member scattered on the predetermined cardboard portion, either only locally at the fastening claws or close thereto. FIG. 4 is a schematic diagram showing an unassembled cardboard, which is an embodiment of the invention. This embodiment is characterized as arranging small slits (about 6 mm) for helping remove the fastening claws only where the fastening claws are located. Reference character S designates such small slit. Overlapped on the serrated member, the slits of this type are supported by the rigidity of the serrated member. This means that the slits have nothing to do with the reduction in the strength of the cardboard. On the other hand, such small slits facilitate the removal of the fastened portions, thus effectively contributing to reducing the fastening strength.

Therefore, it is desirable to use the slits of this type, together with the thin sheet body of the invention, irrespective of the serrated member mounting position. The number and direction of small slits S are selected in accordance with the number and position of fastening claws forming a single fastened portion within such a range as not to impair the fastening of the serrated member. Slits extending substantially in parallel with the longitudinal direction of the serrated member, as shown in FIG. 4, are desirable in facilitating the removal of the fastened portions.

Figure 2A:
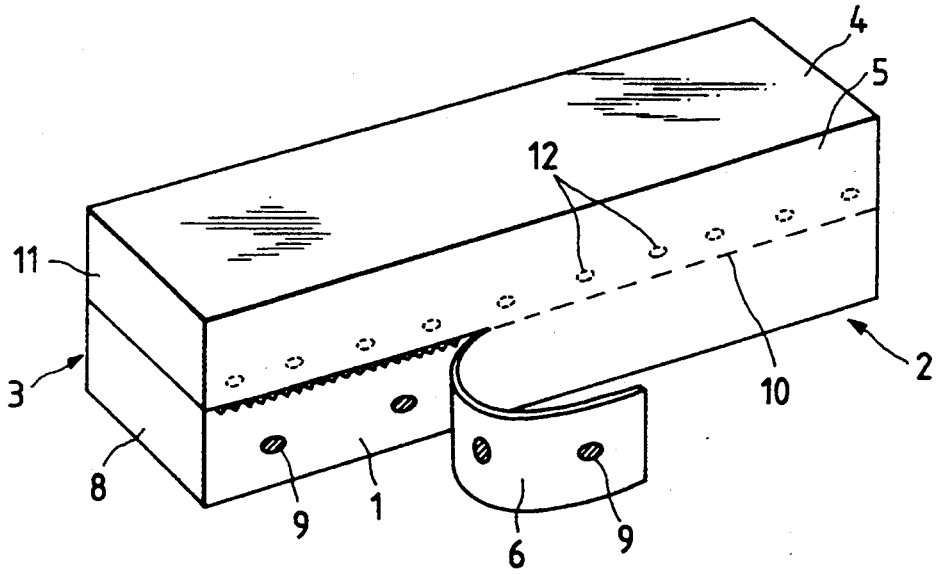
FIGS. 2(A) and 2(B) are schematic diagrams of a containing box to which the present invention is applied.
Figure 2B:
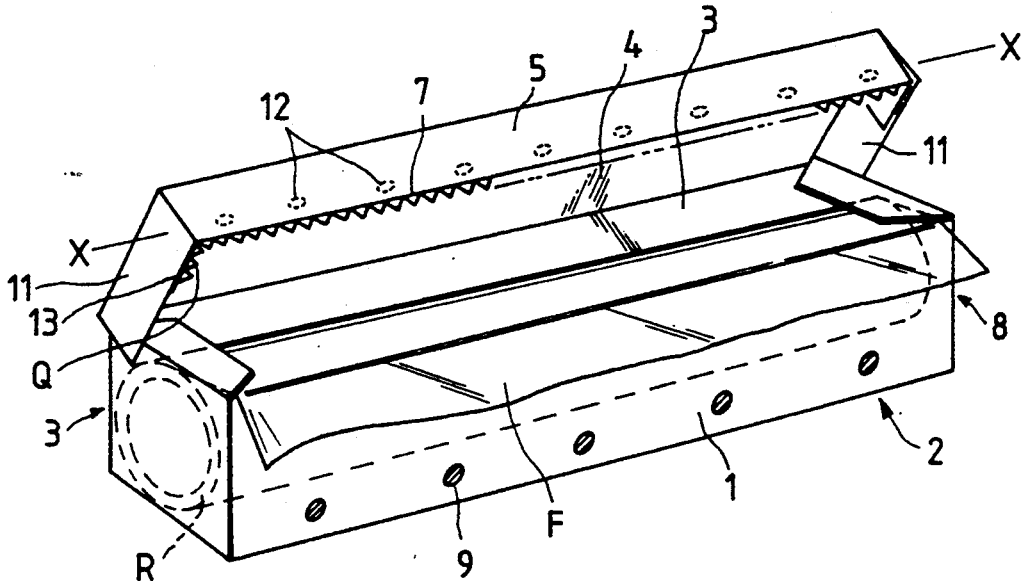
Figure 3A:
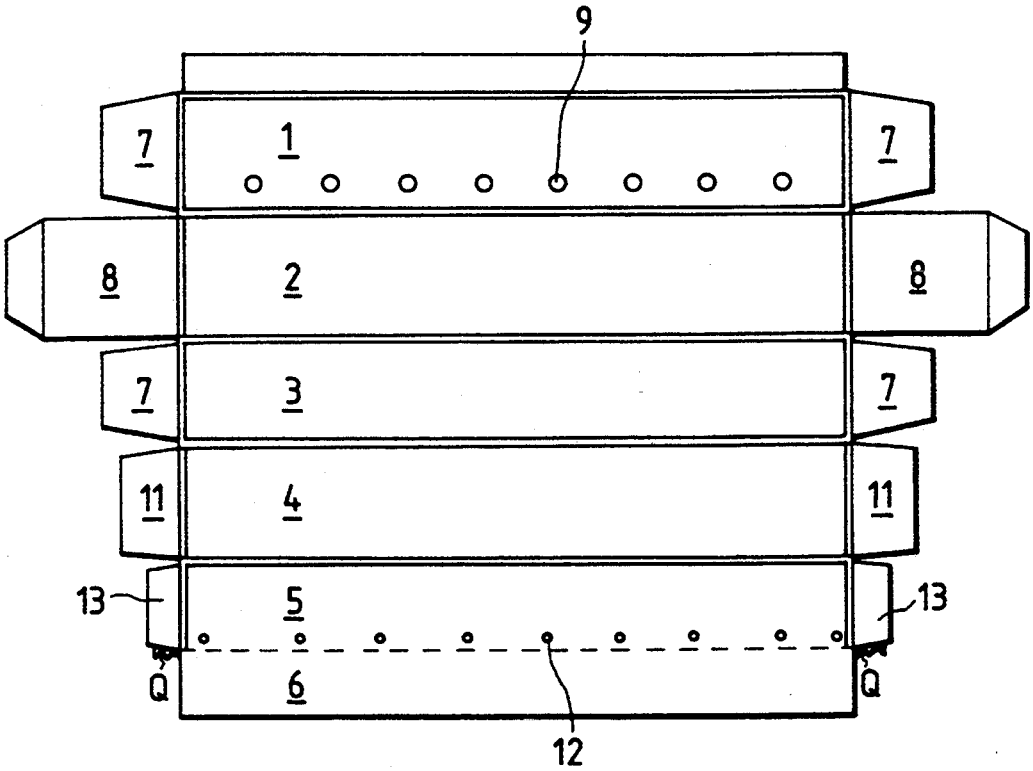
FIGS. 3(A) and 3(B) are schematic diagrams showing a shape of an unassembled cardboard to be formed into the containing box.
Figure 3B:
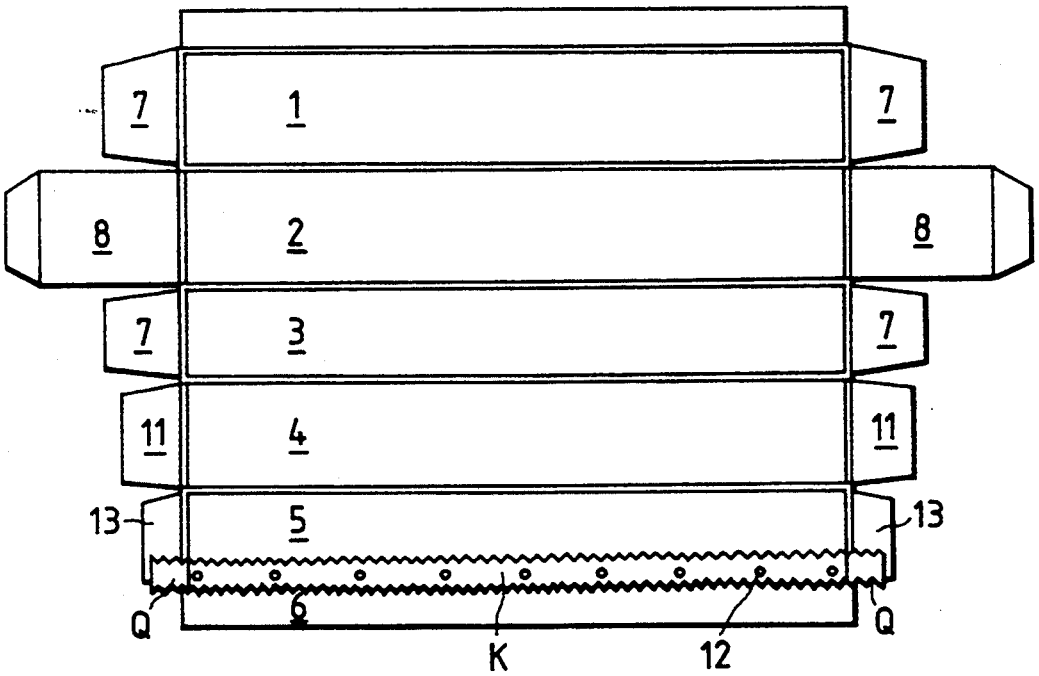

A wrap film containing box of the invention will be described next. FIGS. 2 (A), 2(B) and FIGS. 3 (A), 3(B) are diagrams showing an embodiment of the invention. FIGS. 3(A) and 3(B) show an unassembled cardboard, in which FIG. 3 (A) is a schematic diagram as viewed from the front surface; and FIG. 3(B) is a schematic diagram as viewed from the back surface. FIG. 2(A) is a perspective view of the box body when the box is being opened by removing an opening strip 6 after the box body has been assembled; and FIG. 2 (B) is a perspective view thereof when a film F is slowly paid off after the box body has been opened.

As shown in FIGS. 2 (A), 2(B) and FIGS. 3(A), 3(B), the assembled containing box and the unassembled cardboard of the invention are in no way different from the conventional products in terms of shape, structure, and position of the main components. That is, the containing box of the invention, like the conventional products, is a rectangular box body including a front plate 1, a bottom plate 2, a rear plate 3, a top plate 4, lateral plates 8, a cover strip 5, extending in such a direction as to cover the front plate 1 from the top plate 4, and lateral cover strips 11, extending in such a direction as to cover the lateral plates 8 from the top plate 4. This box body is designed to be opened by removing an opening strip 6 along a cutting line 10 , FIG. 2(A) by tearing off locally bonded portions 9 that bond the back of the opening strip 6 to the front of the front plate 1, and allows a desired amount of rolled film R contained therein to be paid off, and the paid-off film portion to be cut using a metal serrated member K that is fastened by fastening claws 12 located at predetermined positions on the box body (e.g., at the lower end of the cover strip 5).

Where the invention is distinguished from the conventional products is that the metal serrated member K is fastened by the fastening claws 12 with the thin sheet body P, FIG. 1, interposed therebetween on a predetermined cardboard portion of the box body (on the back surface of the lower edge portion of the cover strip 5), and the thin sheet body P is arranged so as to be projected from at least one lateral end in the longitudinal direction of the metal serrated member K. This is shown in FIG. 2(B) and FIGS. 3 (A), 3(B) as projected portions Q of the thin sheet body in such a manner that the projected portions Q are projected slightly from both lateral ends of the serrated member. FIG. 1 is a partially schematic diagram showing a section taken along a line X—X of FIG. 2(B), so that the lower edge portion of the cover strip 5, the thin sheet body P, and the fastening claws 12 are shown in enlarged form. According to FIG. 1, the thin sheet body P is interposed between the back surfaces of both the cover strip 5 and the metal serrated member K, and fastened onto the predetermined cardboard portion by the fastening claws 12 together with the metal serrated member. Thus, the metal serrated member K is fastened onto the cardboard portion through the thin sheet body P. The portions Q projected from the lateral sides of the serrated member are bent along the back surface of auxiliary lateral cover strips 13, thus providing tabs easy to hold at the time of tearing off the serrated member. In addition, as a practical matter, since it is pressed to dig into the surface of the cover strip 5 when the fastening claws 12 are bent, the fastening claws 12 and the thin sheet body P do not stack in the same thickness as shown in FIG. 1. Further, the thin sheet body P is not necessary to exist between the bent portion of the fastening claws 12 and the surface of the cover strip 5.

Therefore, to scrap this box body, a projected portion Q of the thin sheet body P is held and pulled so as to turn the projected portion P up toward the serrated member K. As a result, the removal of the fastened portions is started sequentially in the longitudinal direction of the serrated member, thus allowing both the thin sheet body P and the serrated member K to be easily integrally torn off from the box body surface.

The advantages brought about by the containing box of the invention are that the cutting performance of the serrated member is not impaired and that the serrated member can be removed, with ease, at the time of scrapping the containing box. These advantages of the invention are worth special mention when the invention is applied to a containing box having the serrated member on the lower end of the cover strip, particularly, a containing box on which a serrated member, whose general shape is V-shaped, is mounted on the lower end of the cover strip such as disclosed in Examined Japanese Patent Publication No. Hei. 4-19042. Since stress caused at the time of cutting the film concentrates on the lower end of the cover strip in containing boxes of this type, it is not practical to provide perforations as means for removing the serrated member on such cardboard portion. However, the perforations have still been adopted because there has been no alternative. The invention has overcome such shortcoming by arranging the thin sheet body P on the back of serrated member K. The thin sheet body P arranged on the back of the serrated member K is designed to have such a thickness as to appropriately reduce the fixing strength of the fastening claws 12 so that the tearing force is concentrated on the fastened portions, thereby not adversely affecting the rigidity and strength of the cardboard portion forming the cover strip. Hence, the cutting performance of the serrated member is not reduced and safety in removing the serrated member is ensured, making the containing box of the invention highly useful.

EMBODIMENT

An unassembled cardboard for forming a containing box was prepared by a method similar to the conventional methods using generally used known equipment for forming and mounting metal serrated members. A prepared unassembled cardboard has a serrated member firmly fastened on the back of the lower end of a cover strip. The method of the invention is distinguished from the conventional methods in that a long casting sheet made from polyethylene terephthalate (a 0.1 mm-thick, red-colored sheet) is overlapped on the entire back surface of a long rolled metal thin plate trimmed to a predetermined width (a 0.17 mm-thick tin plate) in such a manner that the casting sheet is projected from both lateral ends of the metal thin plate by 10 mm each. While the operation of forming the serrated member and the fastening claws, as well as the operation of fixing the serrated member, etc. thereafter were performed with the thin sheet body present on the back surface of the metal thin plate, not only was there no inconvenience found in performing these operations, but also the serrated member have the same shape and performance as the conventional ones.

FIGS. 3(A) and 3(B), respectively, show the front and the back of the unassembled cardboard having the serrated member. The thin sheet body P is indicated in FIGS. 3(A) and 3(B) by way of thin sheet projected portions Q projected from both lateral ends of the serrated member. The projected portions are also serrated, because these portions were cut out simultaneously by the lateral margins of the mold during the serrated member forming operation. FIGS. 2(A) and 2(B) show a containing box obtained by assembling such cardboard by folding and bonding and sealing the assembled cardboard after accommodating a rolled film R therein. In FIG. 2(B), the projected portions Q of the thin sheet body are viewed on both lateral ends of the serrated member.

FIG. 1 is a partially schematic diagram showing a section taken along a line X—X of FIG. 2(B), so that the lower edge portion of the cover strip 5, the thin sheet body P, and the fastening claws 12 are shown in enlarged form. According to FIG. 1, the thin sheet body P is interposed between the back surfaces of both the cover strip 5 and the metal serrated member K, and fastened onto the cardboard portion by the fastening claws 12 together with the metal serrated member. Thus, the metal serrated member K is fastened onto the cardboard portion through the thin sheet body P. The portions Q projected from the lateral sides of the serrated member are bent along the back surface of auxiliary lateral cover strips 13, thus providing tabs easy to hold at the time of tearing the serrated member off.

An unassembled cardboard with a serrated member shown in FIG. 4 was prepared by the same manufacturing method as above and a containing box was assembled. What distinguishes the unassembled cardboard of FIG. 4 from that of FIG. 3 (A) is only the arrangement of about 6 mm-long small slits S in the cardboard surface so as to correspond to the respective fastening claws 12. The slits S are made by slitting the cardboard surface predetermined to locate the fastening claws 12 in the stage of preparing the unassembled cardboard for the containing box.

Three hundred containing boxes were prepared for each type of containing box obtained by the above methods for comparison with the conventional products, and then the cutting performance of the film was evaluated by transporting these containing boxes between Suzuka and Tokyo (about 400 km) for three times. The results of the evaluation is as indicated below.

The Reference value of the serrated member tearing strength was determined as follows.

This value is obtained as an average (N=10) of maximum values of load (in kg) required for removing all the fastening claws from the cardboard portion by gripping the serrated member about 2 mm in front of each fastening claw fixed on the cardboard portion of the containing box and pulling up the serrated member at a target speed of 5 mm/min in the vertical direction. Therefore, the magnitude of the reference value may serve as an index of the serrated member tearing strength.

| Fixing structure | Tearing strength | |
|---|---|---|
| | Two fastening strips | Four fastening strips |
| Serrated member only | 1.08 | 1.64 |
| Serrated member and thin sheet body | 0.37 | 0.65 |
| Serrated member and thin sheet body with slits | 0.13 | 0.42 |

The containing boxes of the invention were evaluated as follows.

The presence of the thin sheet body does not impair the cutting function of the serrated member, nor is the cutting function reduced by repeated cutting operations.

There was not a single box in which fastening of the serrated member became loose or whose serrated member was about to come out during transportation or cutting test.

When the serrated member was torn off by holding the projected portion Q of the thin sheet body with the containing box empty, the thin sheet body was not subjected to breakage during the tearing operation, allowing the entire portion of the serrated member to be torn off easily as well as safely. Particularly, the serrated members, with the small slits S, were extremely easy to tear off. The projected portions Q of the thin sheet body effectively serve as a mark for indicating where the tearing tabs are located.

The serrated member removing means can be formed by the same process and method as the conventional ones, thereby making the invention efficient and economical. That there is no such element as to weaken the cardboard portion of the box body deserves special mention.

What is claimed is:

1. A wrap film containing box comprising a rectangular cardboard, which includes a front plate, a bottom plate, a rear plate, a top plate, lateral plates, and a cover strip extending in such a direction as to cover the front plate from the top plate, the wrap film containing box accommodating a rolled wrap film therein and being used by paying off a desired portion of the wrap film and cutting the paid-off portion with a serrated member having a width and lateral ends;

wherein the serrated member is fastened onto a predetermined surface of the box body through a thin sheet body arranged on a back surface of the serrated member, and the thin sheet body has substantially the same width as the serrated member and has a projecting end which projects from at least one lateral end of the serrated member, wherein said projecting end is grippable by a user to facilitate the removal of the serrated member from the containing box.

2. A containing box according to claim 1, wherein a long edge portion of said thin sheet body at least overlapping on the serrated member is serrated in the same form as the serrated member.

3. A containing box according to claim 1, wherein the thin sheet body comprises a plastic film sheet of from 0.05 to 1.5 mm in thickness, the plastic film sheet having a small thermal contraction coefficient.

4. A containing box according to claim 1, wherein the cover strip extends in such a direction as to cover the front plate from the top plate, which is reinforced by integrated lateral cover strips substantially at right angles thereto, the lateral cover strips extending in such a direction as to cover the lateral plates from the top plate; and the serrated member and the thin sheet body are fixed on a lower back surface of the cover strip.

5. A containing box according to claim 1, wherein slits are provided at positions where fastening claws for fastening the serrated member and the thin sheet body on the cardboard surface of the box body are provided, the slits being small and serving to help remove the fastening claws.

* * * * *

UNITED STATES PATENT AND TRADEMARK OFFICE

CERTIFICATE OF CORRECTION

PATENT NO.: 5,423,464
DATED : June 13, 1995
INVENTOR(S): YUKI et al.

It is certified that error appears in the above-identified patent and that said Letters Patent is hereby corrected as shown below:

On the title page, after Item [22], please delete the following:

[30] Foreign Application Priority Data
Jul. 31, 1992 [JP] Japan .....4-204710

Signed and Sealed this

Nineteenth Day of December, 1995

Bruce Lehman

*Attest:*

BRUCE LEHMAN

*Attesting Officer*

*Commissioner of Patents and Trademarks*